US005575858A

United States Patent [19]

Chen et al.

[11] Patent Number: 5,575,858

[45] Date of Patent: Nov. 19, 1996

[54] EFFECTIVE CLEANING METHOD FOR TURBINE AIRFOILS

[75] Inventors: Otis Y. Chen; Kim C. Seow; Choo B. Lim, all of Singapore, Singapore

[73] Assignee: United Technologies Corporation, Hartford, Conn.

[21] Appl. No.: 236,602

[22] Filed: May 2, 1994

[51] Int. Cl.[6] ..... C23G 1/02; B08B 3/10; B08B 9/093

[52] U.S. Cl. ..... 134/3; 134/22.19; 134/26; 134/28

[58] Field of Search ..... 134/22.12, 22.14, 134/22.17, 22.18, 22.19, 26, 28, 29, 2

[56] References Cited

U.S. PATENT DOCUMENTS 3,291,640 12/1966 Livingston ..... 134/22.14 X
3,951,681 4/1976 Shoemaker et al. ..... 134/29 X
4,317,685 3/1982 Ahuja et al. ..... 134/2
4,439,241 3/1984 Ault et al. ..... 134/22.17
4,713,120 12/1987 Hodgens, II et al. ..... 134/3

*Primary Examiner*—Jill Warden
*Assistant Examiner*—Saeed Chaudhry

[57] ABSTRACT

A cleaning method for gas turbine engine airfoils includes a step of autoclave process cleaning and a step of chelating agent solution cleaning. The cleaning method also includes water rinsing after the autoclave cleaning and after the chelating agent solution cleaning. A subsequent step of high pressure water jet spray removes the debris. The cleaning method of the present invention significantly reduces the number of cleaning cycles required to clean the airfoils.

9 Claims, 2 Drawing Sheets

EFFECTIVE CLEANING METHOD FOR TURBINE AIRFOILS

TECHNICAL FIELD

This invention relates to gas turbine engines and, more particularly, to the cleaning of airfoils therefor during overhaul and repair.

BACKGROUND OF THE INVENTION

A typical gas turbine engine includes a compressor, a combustor, and a turbine. Both the compressor and the turbine include alternating rows of rotating and stationary airfoils. Air flows axially through the engine. As is well known in the art, the compressed gases emerging from the compressor are mixed with fuel in the combustor and burned therein. The hot products of combustion, emerging from the combustor at high pressure, enter the turbine where the hot gases produce thrust to propel the engine and to drive the turbine which in turn drives the compressor.

The gas turbine engine operates in an extremely harsh environment characterized by vibrations and very high temperatures. The airfoils in the turbine are in jeopardy of burning because of the hot gases emerging from the combustor. Various cooling schemes exist to provide adequate cooling to these turbine airfoils. Many of these cooling schemes include intricate internal passages, such as a serpentine passage, that vent cooling air therethrough. The cooling schemes also include tiny cooling holes formed within the wall structure of the airfoils to allow the cooling air to pass therethrough.

The air that circulates through the airfoils, particularly during operation on the ground, includes particles of sand, dust, and other contaminants that have been ingested by the engine. The sand and dust, aided by extremely high temperatures and pressures, adhere to the surface of the internal cavity of the airfoils forming a crust, which may reduce the size or block entirely the air holes and the internal passages within the airfoil, thereby reducing the efficiency of the cooling thereof. To ensure that internal cavities are passable for the cooling air, the airfoils must be cleaned periodically during their lifetime or replaced. Since the airfoils are manufactured from expensive materials to withstand high temperatures, vibrations and cycling, frequent replacement of all the airfoils would be very costly. Therefore, cleaning of the airfoils is preferred. Furthermore, each engine includes hundreds of airfoils. Any reduction in time to clean each airfoil can potentially result in tremendous time savings and subsequently lead to significant cost savings.

A solution of VERSENE®, the tetra-sodium salt of ethylenediamine tetra acetic acid EDTA, is a known cleaning solution in the aerospace industry. VERSENE, a registered trademark of Dow Chemical Company, acts as a metal chelating agent and is generally non-corrosive to the airfoils. However, the VERSENE solution has been known to be ineffective in terms of removing deposits from the internal cavities of airfoils. The VERSENE solution does not dissolve or remove the crust, but merely changes the characteristics of the crust in a chemical reaction.

Another known process for cleaning the internal cavities of the airfoils is an autoclave process. The autoclave process involves exposing the airfoils to high temperature and pressure fluid for a period of time. The process results in a loosening of the sand and dust layer. Following the autoclaving, a water blast at high pressure, directed at the internal cavity, removes the loosened layer of the sand and dust. Each airfoil must undergo many autoclave cycles to be effectively cleaned. Each cycle is time consuming and costly. Moreover, the autoclave process is effective in removing the crust only when the build-up is fine or the internal passage is not complicated. However, the method is not effective when the dust layer is thick or the passage is complicated.

The aerospace industry, in general, and overhaul and repair shops for the aerospace industry, in particular, are at loss as to how to effectively clean airfoils with intricate internal cooling passages. There is a potential for a great deal of cost savings on replacement airfoils if the cleaning process for the old airfoils is improved. Although the airfoil structure has become very sophisticated, the entire industry is searching for an improved method of cleaning the airfoils.

DISCLOSURE OF THE INVENTION

According to the present invention, a method for cleaning a gas turbine engine airfoil with internal cavities includes a step of cleaning the airfoil in an autoclave process and a step of soaking the airfoils in a chelating agent solution. Additional steps of water rinsing can be added after chelating agent solution cleaning and after the autoclave cleaning. A subsequent step of high pressure water jet spray of the internal cavities of the airfoil helps to remove the crust debris from the internal cavities of the airfoil. The entire process can be repeated as many times as necessary for adequate cleaning. In the preferred embodiment of the invention the chelating agent is the tetra-sodium salt of ethylenediamine tetra acetic acid (EDTA).

The cleaning method combining autoclave process with chelating agent solution cleaning produces a synergistic effect and results in an improved cleaning for the airfoil. The primary advantage of this process is that it significantly reduces time required to clean the airfoils. Specifically, the new process that includes combination of chelating agent solution cleaning and autoclave cleaning reduces the number of autoclave cycles in half that would be necessary to clean the airfoil when autoclave cleaning was used alone. The chelating agent solution cleaning alone does not remove the crust at all. The time savings result in significant cost savings.

The foregoing and other advantages of the present invention become more apparent in light of the following detailed description of the exemplary embodiments thereof, as illustrated in the accompanying drawings.

BEST MODE FOR CARRYING OUT THE INVENTION

Figure 1:
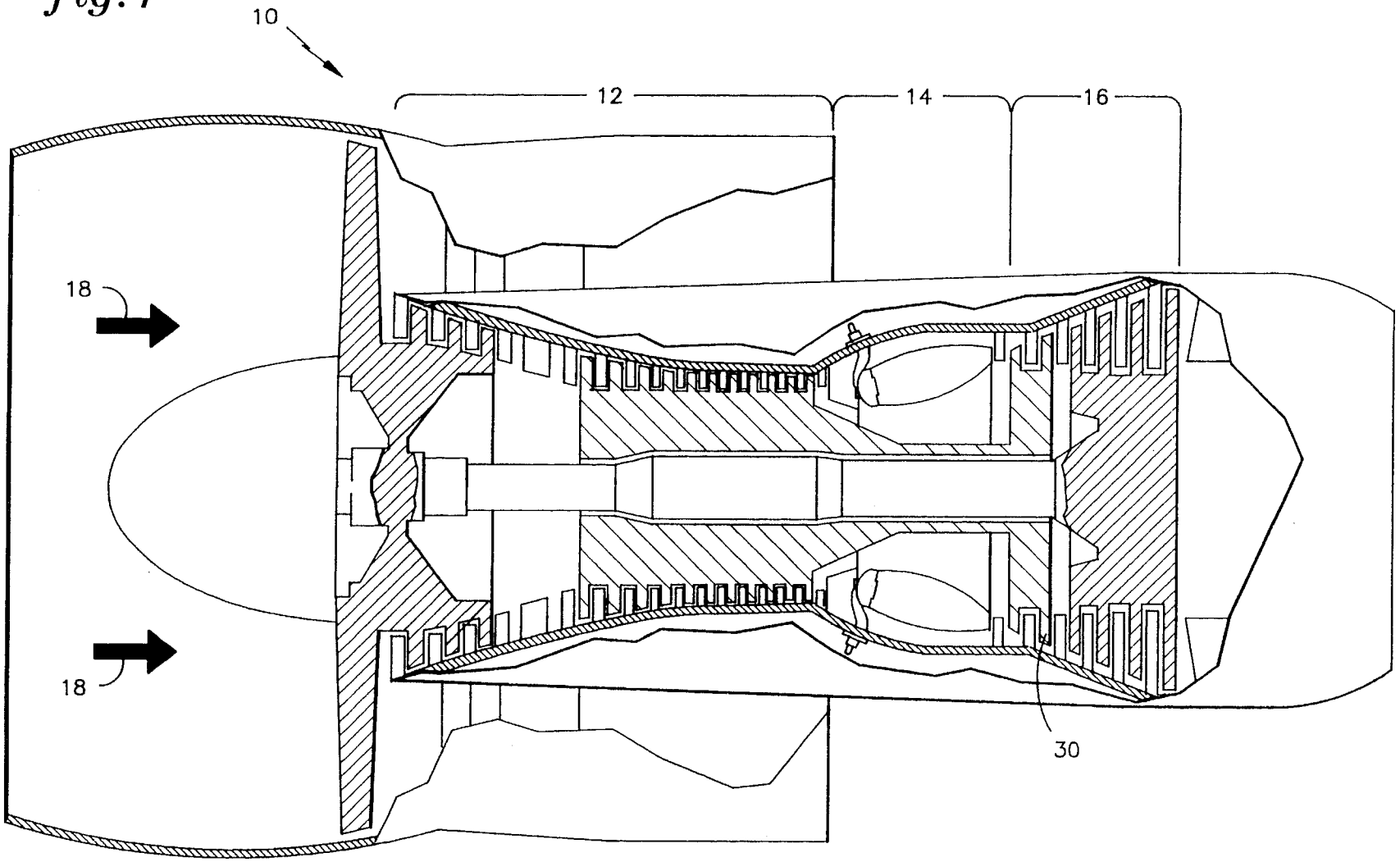
FIG. 1 is a schematic partially sectioned elevation of a gas turbine engine.

Referring to FIG. 1, a gas turbine engine 10 includes a compressor 12, a combustor 14 and a turbine 16. Air 18 flows axially through the engine 10. As is well known in the art, air 18 is compressed in the compressor 12. Subsequently, the compressor air is mixed with fuel and burned in the combustor 14. The hot products of combustion enter the turbine 16 wherein the hot gases expand to produce thrust to propel the engine 10 and to drive the turbine 16, which in turn drives the compressor 12.

Figure 2:
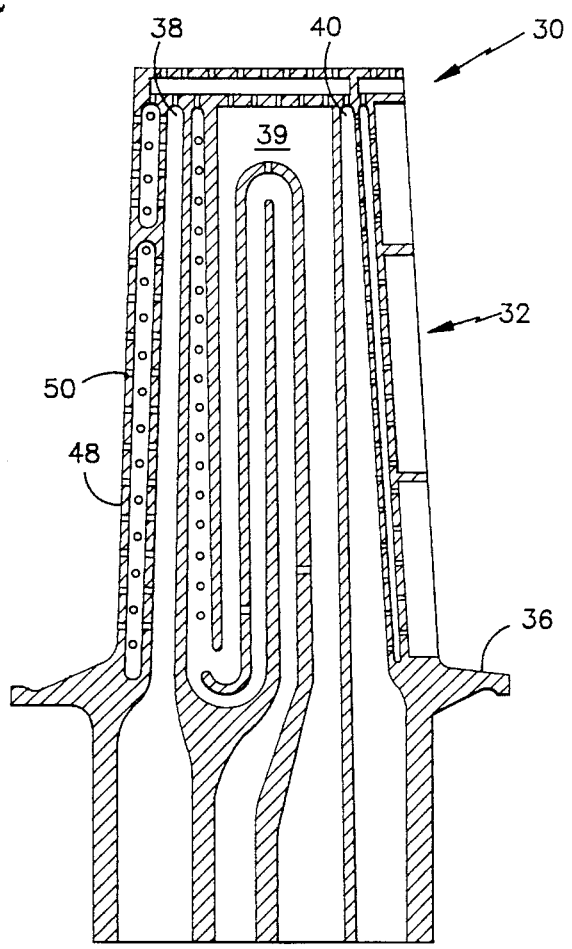
FIG. 2 is an enlarged sectional elevation of an airfoil.

Both the compressor 12 and the turbine 16 include alternating rows of rotating and stationary airfoils 30. Each airfoil 30, as shown in FIG. 2, includes an airfoil portion 32 and an inner diameter platform 36. The turbine airfoils 30 include elaborate internal passages 38–40 that channel cool air therethrough to cool airfoil walls 48. The airfoil walls 48 include a plurality of film holes 50 that allow cool internal air to exit the internal passages 38–40 of the airfoil 30. As cooling air passes through the internal cooling passages 38–40 at high temperature and pressure, dust and sand particles that are ingested by the engine 10 adhere to the internal walls 48 of the passages 38–40. The particles form a layer of crust that reduces the size of the internal passages 38–40 and can block the film holes 50. The complete or partial blockage of the passages 38–40 and the film holes 50 causes inefficiency in engine performance and can result in burning of the airfoil walls. The airfoils are periodically removed from the engine for cleaning purposes.

In such a cleaning process, the airfoil 30 is subjected to an autoclave process. A 40–50% KOH solution (potassium hydroxide or lye) is superheated to 325°–450° F. The airfoil is soaked for 24 hours at a temperature of 325°–450° F. and pressure of 200–300 psi. The autoclave process elevates the crust from the internal wall surface. The airfoil is subsequently rinsed with water.

The airfoil 30 is then immersed into a chelating agent solution. The chelating agent solution is VERSENE® 220 Crystal chelating agent containing 99% tetra-sodium salt of ethylenediamine tetra acetic acid (EDTA). The concentration is 130 ml Triton x-100 (wetting agent) and 5.2 kg of VERSENE 220 in 52 liters of water. The airfoil is ultrasonically agitated for 1–4 hours at 140°–160° F. Triton X-100 is manufactured by E. Merck of 64271 Darmstadt, Germany and has a chemical composition of assay (achidimetric) having 98.07%, free acid (as $CH_3COOH$) less than 0.01%, free alkali (as $NH_3$) less than 0.01%, density (D 20/4) 1.0648, turbidity point 68° C., water less than 0.2%, sulfated ash less than 0.1%. The VERSENE cleaning chemically changes the characteristic of the crust layer adhered to the internal walls 48 of the internal passages 38–40 to make it more soluble in water. The airfoil is subsequently rinsed with water. A high pressure water (5,000–10,000 psi) jet is then applied to the airfoil. The water jet spray removes the crust debris from the internal passages.

Figure 3:
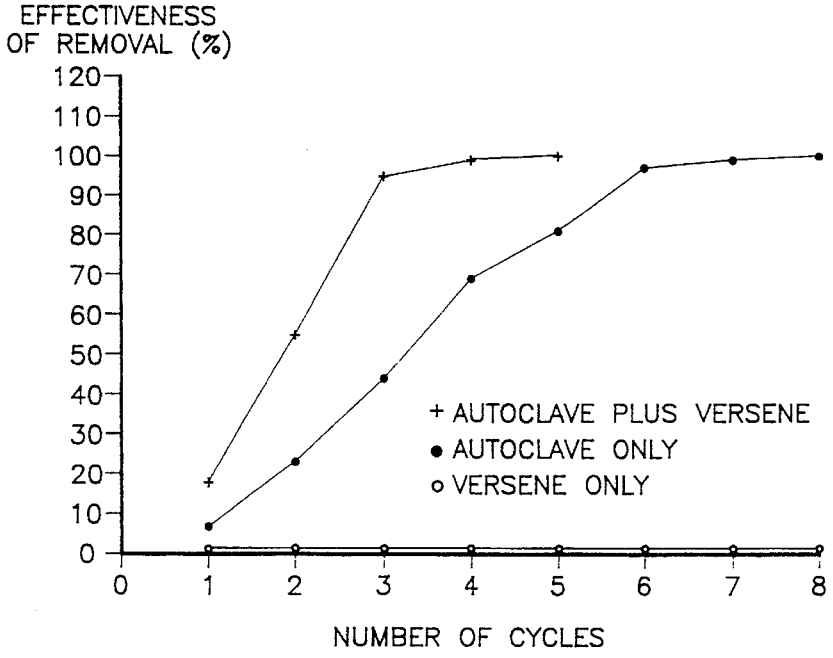
FIG. 3 is a chart of effectiveness of a cleaning process according to the present invention versus processes used in prior art.

The process produces a synergistic effect and results in an extremely effective cleaning method for the airfoils. The process also satisfies a long felt need in the aerospace industry for effective airfoil cleaning. FIG. 3 charts percentage of crust removed from the airfoil versus a number of cycles it takes to remove such percentage of crust. The line with darkened circles thereon represents cleaning with an autoclave alone, whereas the line with plain circles thereon represents cleaning with VERSENE alone. The line with plus signs thereon represents cleaning with VERSENE and autoclave combined. For example, it requires six autoclave cycles to obtain 97% clean airfoil, whereas it requires only three cycles to obtain 95% clean airfoil when the process of the present invention is used. VERSENE cleaning alone does not remove crust at all. The reduction of cycles in half represents significant savings in time that translates in substantial cost savings. The importance of such savings can be underscored by the fact that each gas turbine engine includes hundreds of airfoils. Reducing the time in half for cleaning each airfoil also means that the time for cleaning all airfoils in the engine is reduced in half.

Although the invention has been shown and described with respect to exemplary embodiments thereof, it should be understood by those skilled in the art that various changes, omissions, and additions may be made thereto, without departing from the spirit and scope of the invention. For example, the specification described the preferred embodiment of the present invention having the chelating agent solution containing tetra-sodium salt of ethylenediamine tetra acetic acid. However, other chelating agent solutions can be used as well.

We claim:

1. A method for cleaning internal cavities of an airfoil of a gas turbine engine, said method characterized by the steps of:

cleaning said airfoil in an autoclave cleaning process by exposing said airfoil to high temperature and pressure fluid for a period of time; and soaking said airfoil in a chelating agent solution.

2. The method for cleaning of claim 1 characterized by said method including additional steps of rinsing said airfoil in water following said step of cleaning said airfoil in said autoclave cleaning process and following said step of soaking said airfoil in said chelating agent solution.

3. The method for cleaning of claim 1 characterized by a subsequent step of using high pressure water jet to remove debris from said internal cavities.

4. The method for cleaning of claim 1 characterized by said chelating agent being tetra-sodium salt of ethylenediamine tetra acetic acid (EDTA).

5. The method for cleaning of claim 1 characterized by said chelating agent solution comprising 130 ml of a wetting agent and 5.2 kg of tetra-sodium salt of ethylenediamine tetra acetic acid per 52 liters of water.

6. The method for cleaning of claim 1 characterized by a soak time in said chelating agent solution being 1–4 hours at 100°–160° F.

7. The method for cleaning of claim 1 characterized by said airfoil being subjected to ultrasonic agitation during said chelating agent solution soaking.

8. The method for cleaning of claim 1 characterized by said autoclave process including soaking said airfoil in 40–50% KOH (potassium hydroxide) at temperature 325°–450° F. at pressure of 200–300 psi for 24 hours.

9. The method for cleaning of claim 5 characterized by said wetting agent having chemical composition of assay (achidimetric) having 98.07%, free acid (as $CH_3COOH$) less than 0.01%, free alkali (as $NH_3$) less than 0.01%, density (D 20/4) 1.0648, turbidity point 68° C., water less than 0.2%, sulfated ash less than 0.1%.

* * * * *